United States Patent [19]

Noda

[11] 4,172,975

[45] Oct. 30, 1979

[54] DRYING AND FIXING DEVICE

[75] Inventor: Kazuo Noda, Tokyo, Japan

[73] Assignee: Olympus Optical Co., Ltd., Hatagaya, Japan

[21] Appl. No.: 905,442

[22] Filed: May 12, 1978

[30] Foreign Application Priority Data

May 17, 1977 [JP] Japan ..... 52-62945

[51] Int. Cl.[2] ..... H05B 1/00; G03G 15/20

[52] U.S. Cl. ..... 219/216; 219/388; 219/469; 432/60; 432/228

[58] Field of Search ..... 219/216, 388, 469, 470, 219/471; 355/3 FU; 432/60, 228; 34/124, 120, 123, 119; 100/93 RP

[56] References Cited

U.S. PATENT DOCUMENTS

| | | | |
|---|---|---|---|
| 3,797,127 | 3/1974 | Yamada et al. | 219/469 |
| 3,945,726 | 3/1976 | Ito et al. | 219/216 |

OTHER PUBLICATIONS

Limberger, et al., German Application No. 1,101,148, 3/61.

*Primary Examiner*—C. L. Albritton
*Attorney, Agent, or Firm*—Haseltine, Lake & Waters

[57] ABSTRACT

A drying and fixing device for a recording paper comprises a heat drum and a feeding means cooperated thereto in order to dry and fix the recording paper having developed toner image by contacting the paper to the heat drum. The feeding means comprises feed rollers arranged at the forward direction, viewed in the direction of progress of the recording papers, in conact with the heat drum and feed rollers arranged to the heat drum with a certain distance at the backward direction, viewed in the direction of progress of the recording paper.

4 Claims, 3 Drawing Figures

DRYING AND FIXING DEVICE

BACKGROUND OF THE INVENTION

The present invention relates to a device for drying and fixing a toner image developed on a recording paper by liquid developer including toner particles therein.

In an electrophotographic apparatus adopting a wet developing system a recording or copying paper which has an electrophotographic latent image formed thereon is subjected to touch or contact with a liquid developer including toner particles therein, a toner image is formed on the recording paper by developing the latent image with the toner particles in the liquid developer, the thus formed toner image is fixed by heating and the recording paper with fixed toner image is finally dryed.

Such a drying and fixing device comprises a heat drum and feed rollers which consist of a heat resistance resin and are arranged in parallel with a certain distance, and these feed rollers are pressed to the heat drum by its own weight or a spring to dry and fix the recording paper during conveying it between the feed rollers and the heat drum. In this device, however, the image parts of the picture image formed on the recording paper which are not contacted to the feed rollers are not fixed to form an undersired white portion, or the background white parts of the recording paper which are contacted to the feed rollers are blackened to form roller tracks so that a good quality of copied image can not be obtained. For preventing such a defect means for floating the feed rollers on the heat drum has been provided. In this case the contact of the recording paper to the heat drum becomes worse so that the effect of drying and fixing the toner image is fallen and thus feeding of the recording paper can not be effected smoothly.

SUMMARY OF THE INVENTION

An object of the present invention is to eliminate the above mentioned disadvantages of the conventional drying and fixing device.

Another object of the present invention is to provide a device for drying and fixing a toner image formed on a recording paper in which the recording paper is suitably dried and fixed without forming of the above mentioned undersired white portions and the roller tracks.

According to the present invention a drying and fixing device for a recording paper having developed toner image comprises a heat drum for drying and fixing the recording paper by contacting it thereto and a feeding means cooperated to the heat drum for conveying the recording paper between the feeding means and the heat drum, and the feeding means includes feed rollers arranged at the forward direction, viewed in the direction of progress of the recording papers, in contact with the heat drum and feed rollers arranged to the heat drum with a certain distance at the backward direction, viewed in the direction of progress of the recording paper.

DETAILED DESCRIPTION OF THE INVENTION

Figure 1:
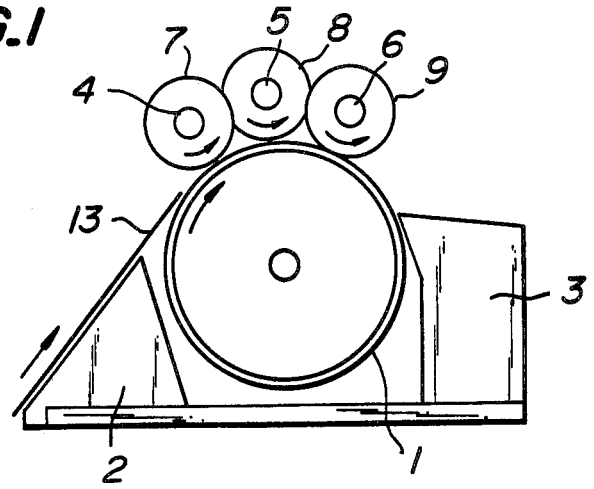
FIG. 1 is a elevational view showing one embodiment of a device for drying and fixing a toner image formed on a recording paper according to the present invention.
Figure 2:
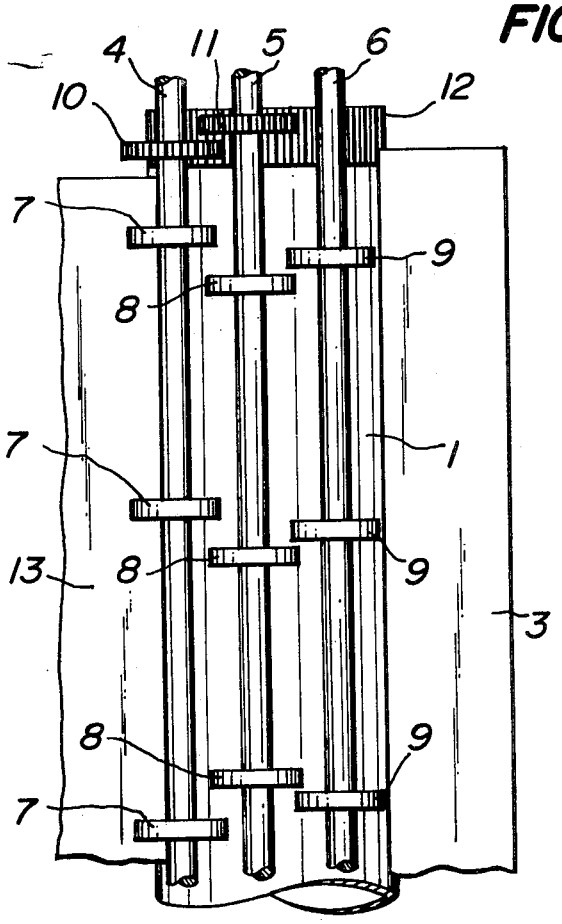
FIG. 2 is a plan view showing the device shown in FIG. 1.

Referring now to FIGS. 1 and 2 one embodiment of a drying and fixing device for toner image formed on the recording paper according to the present invention is shown.

As shown in FIG. 1 the drying and fixing device comprises a heat drum 1 which rotates in the direction of the arrow, guide members 2 and 3 arranged both sides of the heat drum 1 and three shafts 4, 5 and 6 which are separated respectively and arranged in parallel with each other as well as to the heat drum 1. As seen from FIG. 2 the shaft 4 is provided with a plurality of feed rollers 7 each having narrow width which are arranged at equal spaces. The shafts 5 and 6 are also provided with a plurality of rollers 8 and 9 respectively as in the same manner as the shaft 4. The feed rollers 7, 8 and 9 are so arranged that they overlapped with each other, viewed along the axis of the shafts, and the feed rollers 7 and 8 secured to the shafts 4 and 5 are arranged with a certain distance (about 0.7 mm) to the heat drum 1 so as not to contact to the heat drum 1. The feed rollers 9 secured to the shaft 6 are contacted to the surface of the heat drum 1 by its own weight or a spring having weak bias force. The driving of the heat drum 1 and the feed rollers 7 and 8 is realized by connecting the shaft 4 to a driving motor (not shown), by providing gears 10 and 11 to the shafts 4 and 5, respectively, and by engaging the gears 10 and 11 with a gear 12 provided to the periphery of the heat drum 1. A recording paper 13 which has been developed in a developing device (not shown) is dried and fixed during conveying between the heat drum 1 and the feed rollers 7, 8 and 9 through the guide member 2 as shown by arrows.

Figure 3:
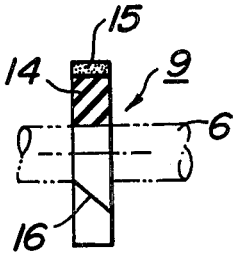
FIG. 3 is a fragmentary sectional view showing another construction of the feed rollers contacted to the heat drum shown in FIGS. 1 and 2.

According to the drying and fixing device described above the developed recording paper 13 is substantially dryed and fixed during conveying between the heat drum 1 and the feed rollers 7 and 8 and is finally dryed and fixed by contacting the recording paper by the heat drum 1 and the feed roller 9 without causing the undesired white portions and the blackened roller tracks. The feed roller 9 is preferably formed by asbestos or unwoven fabric having heat resistance rather than formed by the heat resisting resin since the feed roller formed by asbestos or unwoven fabric having heat resistance may not be liable to form the blackened roller tracks. The FIG. 3 is a fragmentary sectional view of the feed roller 9 using unwoven fabric having heat resistance. The unwoven fabric having heat resistance 15 (for example Nomex, trade mark, made by Dupont) is secured on the periphery of a heat resisting rubber 14 having an inner diameter smaller than an outer diameter of the shaft 6 to which the feed rollers 9 are secured. If the junction 16 of the heat resisting unwoven fabric 15 is arranged to the shaft 6 in parallel the unwoven fabric 15 is liable to line-contact to the recording paper 13 so as to form line tracks on the surface of the paper so that the unwoven fabric 15 may preferably be point-contacted to the recording paper 13 by arranging the unwoven fabric to the shaft 6 at an angle of inclination. It is preferable that the feed rollers 9 can be secured to the shaft 6 only by inserting the shaft 6 in the feed rollers 9.

The feed rollers 7 and 8 may be constructed by the heat resisting resin because these rollers 7 and 8 do not contact to the heat drum 1 and thus recording paper 13. In the drying and fixing device according to the present invention the feed rollers 7, 8 and 9 are arranged to overlap with each other so that the conveying of the recording paper 13 can be made very smooth.

According to the drying and fixing device described above the feed rollers provided at the forward direction, viewed in the direction of progress of the recording paper to be dryed and fixed, are arranged in contact with the heat drum and the feed rollers provided at the backward direction, viewed in the direction of progress of the recording paper, are arranged to the heat drum with a certain distance so that the recording paper may substantially be dryed and fixed until it reaches at the feed rollers contacted to the heat drum and thus the roller tracks can not be formed on the surface of the recording paper even if the recording paper is pressed between the heat drum and the feed rollers. Therefore, the drying and fixing of the recording paper can preferably be obtained.

It will be obvious that the present invention is not restricted to the embodiments described above, but that many variations are possible to those skilled in the art without departing from the scope of this invention. For example, the feed rollers 9 to be contacted to the heat drum 1 may be replaced by a column shaped or a cylindrical roller which is extended in the axial direction of the heat drum 1.

What is claimed is:

1. A drying and fixing device for a recording paper having a developed toner image comprising a heat drum for drying and fixing the recording paper by contacting it thereto and a feeding means cooperated to the heat drum for conveying the recording paper between the feeding means and the heat drum, the feeding means including feed rollers on a shaft arranged at the forward direction, viewed in the direction of progress of the recording papers, in contact with the heat drum and feed rollers on a shaft arranged to the heat drum with a certain distance at the backward direction, viewed in the direction of progress of the recording paper.

2. A drying and fixing device as claimed in claim 1, wherein said feed rollers in contact with the heat drum and the feed rollers arranged to the heat drum with a certain distance have a width smaller than that of the heat drum and pluralities of said feed rollers are secured to each shaft and are overlapped with each other when viewed in the axial direction of the shaft.

3. A drying and fixing device for a recording paper having a developed toner image comprising a heat drum for drying and fixing the recording paper by contacting it thereto and a feeding means cooperated to the heat drum for conveying the recording paper between the feeding means and the heat drum, the feeding means including feed rollers arranged at the forward direction, viewed in the direction of progress of the recording papers, in contact with the heat drum and feed rollers arranged to the heat drum with a certain distance at the backward direction, viewed in the direction of progress of the recording paper; wherein the said feed rollers in contact with the heat drum comprising a boss member having heat resistance and a heat resisting unwoven fabric wound on the boss member.

4. A drying and fixing device as claimed in claim 3, wherein the junction of the unwoven fabric is arranged to the shaft at an inclined angle in the axial direction of the heat drum.

* * * * *